United States Patent [19]

Mazurek

[11] 3,977,354

[45] Aug. 31, 1976

[54] VEHICLE PARKING GUIDE

[76] Inventor: Verny J. Mazurek, 1328 Lakeview Road, Clearwater, Fla. 33516

[22] Filed: July 14, 1975

[21] Appl. No.: 595,771

[52] U.S. Cl. ..... 116/28 R; 49/49

[51] Int. Cl.[2] ..... B60Q 11/00

[58] Field of Search ..... 49/131, 49, 35, 9; 248/291, 292; 116/28 R; 33/264

[56] References Cited

UNITED STATES PATENTS

| | | | |
|---|---|---|---|
| 2,143,997 | 1/1939 | Parkinson | 33/264 |
| 2,454,896 | 11/1948 | Traub | 116/28 R |
| 2,706,462 | 4/1955 | Evans | 116/28 R |
| 3,121,416 | 2/1964 | Gizdich | 116/28 R |
| 3,540,406 | 11/1970 | Dextor | 116/28 R |
| 3,791,337 | 2/1974 | Schamblin | 116/28 R |

*Primary Examiner*—Dennis L. Taylor

*Attorney, Agent, or Firm*—McDougall, Hersh & Scott

[57] ABSTRACT

A parking guide adapted to be mounted alongside the back wall of a garage which includes an elongate member which is pivotally mounted to extend into the path of the forwardmost portion of the vehicle and into full view of the driver so that movement will be imparted to the elongate member in full view of the driver as the vehicle moves to the desired parking position.

6 Claims, 6 Drawing Figures

VEHICLE PARKING GUIDE

This invention relates to a guide which enables an automotive vehicle to be accurately parked in a carport or garage, at a predetermined safe distance from the back wall.

Drivers often find it difficult to know exactly where the vehicle is relative to the back wall when parking in a carport or garage. Occasionally, the vehicle is allowed to go beyond the desired position so that it accidentally comes into engagement with the back wall. This not only subjects the vehicle to possible damage and costly repair, but damage is also often inflicted on the building structure. The embarrassment often leads to frustration with the result that the undesirable movement of the automated vehicle may be accentuated.

With a view towards overcoming this problem, abutments, such as wooden, metal or cement blocks, have been fastened or otherwise positioned on the floor to lie in the path of the front wheels of the automotive vehicle for engagement when the automotive vehicle arrives at the desired parked position. The problems with such floor abutments are (1) they interfere with floor cleaning operations; (2) they deteriorate to the extent that they present an unsightly appearance and require frequent replacement or repair; (3) very often the driver relies entirely upon the engagement to signal the application of brake and, when the wheels miss the abutment, the automotive vehicle smashes into the back wall; and (4) the frequent change in the length or other dimension of the vehicle requires re-location of the abutment means.

Thus it is an object of this invention to provide a parking guide which can be permanently mounted on the back wall of the carport or garage in a position to be engaged by the vehicle, with portions of the guide continuously in view of the driver to signal the exact location of the vehicle relative to the back wall, while at the same time providing means for alignment of the vehicle between the side walls of the carport or garage.

It is a further object of the invention to provide a parking guide of the type described which is off the floor; which is not subject to deterioration or wear; which can be manufactured of readily available and inexpensive materials; which can be installed in the desired position of use in a simple and efficient manner, without the need of special tools or skilled labor; and in which the parking guide is capable of adjustment between positions of use and non-use and, while in position of use, automatically returns to operative position in response to disengagement upon backing out of the vehicle.

These and other objects and advantages of this invention will hereinafter appear, and for purposes of illustration, but not of limitation, embodiments of the invention are shown in the accompanying drawing, in which FIG. 1 is a side elevational view showing the parking guide of this invention in position of use;

Figure 1:
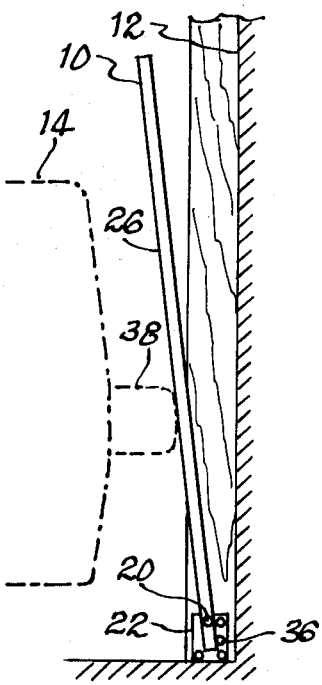
Figure 2:
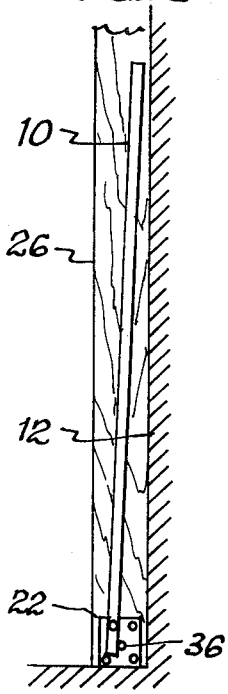
FIG. 2 is a view similar to that of FIG. 1 showing the parking guide in position of non-use.
Figure 3:
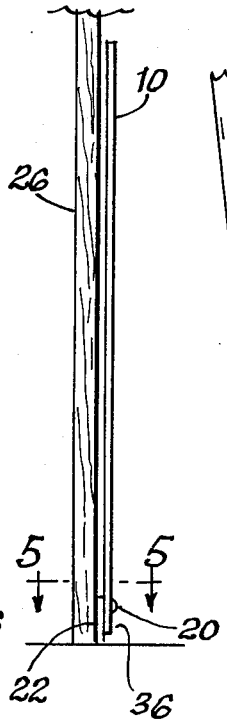
FIG. 3 is an elevational view from the front side of the parking guide shown in FIG. 1.

Briefly described, the parking guide which forms the subject matter of this invention comprises an elongate rod 10 which is pivotally mounted for rocking movement about a horizontal axis in a direction perpendicular to the back wall 12 of the carport or garage. In position of use, the rod extends at a forward incline from the pivot to a level above the hood 14 of the vehicle so as always to be in full view of the driver.

Thus, the driver can align the vehicle with the parking guide during entry into the carport or garage to achieve the desired relative position of the vehicle therein. As the vehicle approaches the back wall the forwardly inclined rod is in position to be engaged by the front end portion of the vehicle or bumper whereby, in response to continued forward movement, the rod is rocked about its pivot in full view of the driver so that the driver can apply the brakes or otherwise terminate forward movement of the vehicle to the extent that the vehicle can be stopped an exact distance from the wall, as the rod is observed to move to a predetermined position.

Being free to rock about its pivot, the guide rod 10 is automatically returned to its original guide position of use in response to gravitational force or an applied resilient force upon disengagement by the vehicle as it backs out of the garage or carport.

Having described the basic concepts of the invention, detailed description will now be made with reference to the drawing.

The elongate rod 10 is mounted for pivotal movement on a pin 20 which extends horizontally in a direction parallel with the wall 12, from a bracket 22 which is fixed, as by screws 24, to the side wall of a wooden stud 26 forming a part of the back wall of the carport or garage. When the back wall of the carport or garage is formed of cement blocks 28 or other construction which does not make use of wooden studs for receiving the bracket 22, use can be made of a bracket having a perpendicular extension 30 which can be fixed to the wall, as by lugs 32 and the like to mount the bracket 22 to extend perpendicularly from the wall so that the pin 20, pivotally mounting the rod 10 can extend the entire direction.

The bracket 22 is mounted near the bottom of the wall so as to be positioned at a level below the bumper or other forwardmost portion of the vehicle. In the preferred practice, the pin 20 engages the rod 10 a short distance from the lower end of the rod thereby to provide a short length 34 which extends downwardly beyond the pivot. Under these conditions, the bracket is provided with a stop pin 36 offset below and rearwardly from the pivot, with the stop pin extending from the bracket into the path of the extension 34 of the rod to block rotation of the rod beyond its normal position of use wherein the rod is inclined to extend upwardly at a forward incline at an angle with the vertical of about 10°–30° so that an intermediate portion of the rod will be spaced from the wall in a position to be engaged by the bumper 38 or other forwardmost extending portion of the vehicle, while the upper free end portion of the rod 10 will extend still further from the wall to a level above the hood of the vehicle.

Thus, as the vehicle moves forwardly, the intermediate portion of the rod 10 will be first engaged by the bumper 38, whereby continued movement of the vehicle in the direction towards the wall will cause the rod to rock about its pivot in a direction toward the wall, in full view of the driver. Thus, by watching the rod, the driver can align his vehicle and determine exactly where the vehicle is with respect to the back wall.

Since the pivot 20 is forwardly of the stop 36, the rod will remain at a forward incline when the vehicle is parked so that the rod will automatically return to its original position of use in response to gravitational force as the vehicle backs up from its parked position.

Instead of relying on return of the rod by gravitational force, use can be made of a resilient means, such as a coil spring, leaf spring, air cushion, rubber cushion or the like, positioned constantly to urge the rod toward its original position of use.

Figure 4:
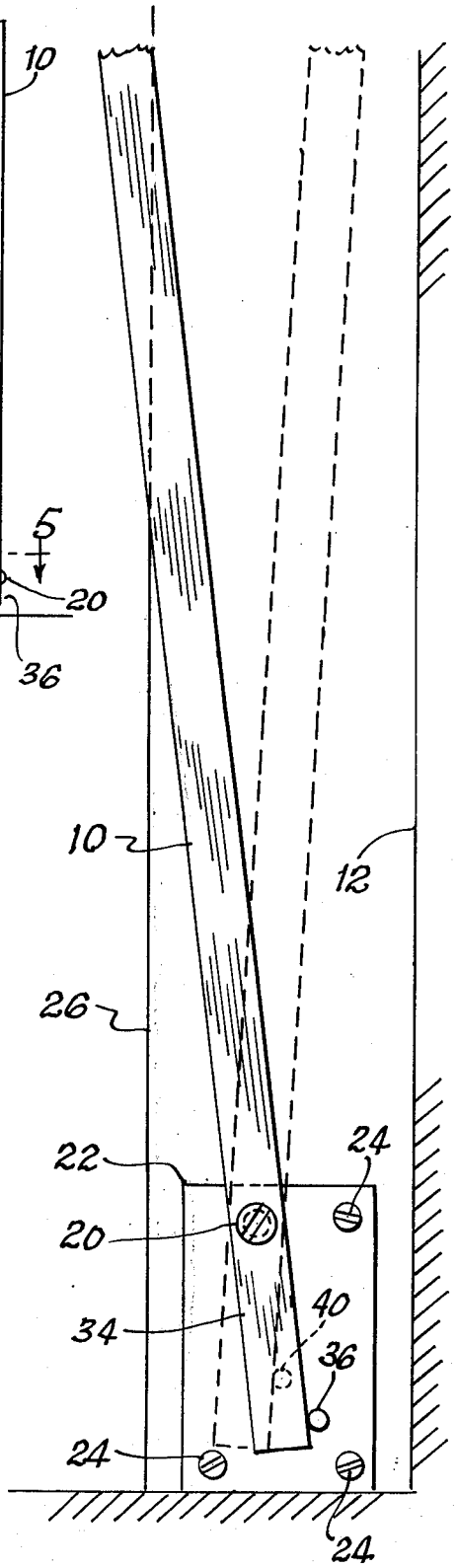
FIG. 4 is an enlarged view similar to that of FIG. 1 showing the parking guide in position of use in solid lines and in position of non-use in broken lines.
Figure 5:
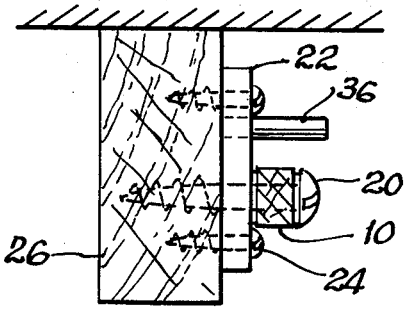
FIG. 5 is a sectional view taken along the line 5-5 of FIG. 3.
Figure 6:
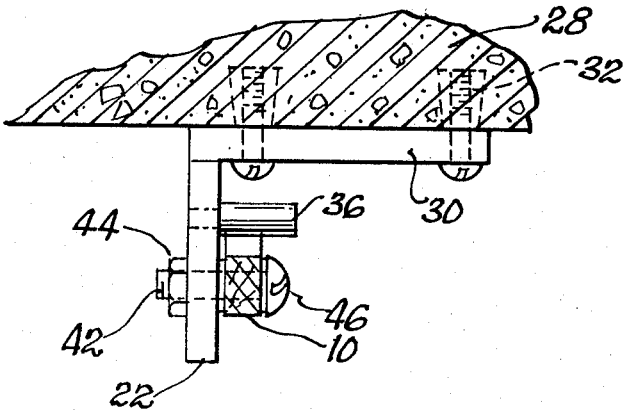
FIG. 6 is a view similar to that of FIG. 5 showing a modification for mounting onto a wall formed of cement or cement blocks.

Often times, it is desirable to inactivate the parking guide for various reasons. For this purpose, an opening 40 is provided in the bracket 22 which is offset forwardly from the stop 36 in position to lie in the path of the rod 10 to be engaged by the rod when rocked to inactive position indicated by the broken lines in FIG. 4 of the drawing.

In the illustrated modification, the pivot pin 20 on which the rod is pivotally supported, is shown as a bolt 42 which extends through an opening in the upper portion of the bracket 22 with the through-extending portion engaged by a lock nut 44. The portion between the head 46 and the bracket 22 extends through an opening in the rod 10 to support the rod for pivotal movement.

The stop pin 36 can be fixed to form a permanent part of the bracket but it is preferred to form the bracket with a pair of openings dimensioned to receive the stop pin. Thus the pin can be located in the opening of 36 to engage the rod when in position of use, as shown by the solid lines in FIG. 4, or the pin can be removed for replacement into the opening 40 to hold the rod in the position of non-use as shown by the broken lines in FIG. 4.

In an obvious modification, the pivot can be located at the lower end portion of the bracket. Under such circumstance the stop pin 36 for engaging the rod in position of use would be offset above and forwardly of the pivot to engage the forward edge of the rod in its position of use. Under such circumstances, the pin or its opening for stopping the rod in the inactive position would be located rearwardly of the pivot.

The operation of the parking guide will be apparent from the description. The rod will extend at a forward incline from the pivot to a level above the hood of the vehicle.

The driver can always observe the rod to guide the vehicle into the carport or garage. As the vehicle approaches the back wall, an intermediate portion of the rod will be engaged by the bumper whereby continued movement of the vehicle towards the back wall will cause the rod to rock about its pivot towards the back wall, in full view of the driver. The driver can observe the movement of the rod and stop the vehicle accordingly before the vehicle hits the back wall and while it is at a desired distance from the wall.

Responsive to the backing of the vehicle out of the carport or garage, the rod will return to its original position of use upon being disengaged by the bumper or other part of the vehicle in engagement therewith.

It will be understood that changes may be made in the details of construction, arrangement and operation, without departing from the spirit of the invention, especially as defined in the following claims.

I claim:

1. A parking guide for assisting the driver of an automotive vehicle to park the vehicle in a carport or garage in close proximity with the back wall without hitting the back wall comprising an elongate member, a bracket attached to the back wall of the carport or garage, means mounting the elongate member on the bracket, for pivotal movement about a horizontal axis in a direction perpendicular to the back wall of the carport or garage and at a level below the forwardmost portion of the vehicle, with the elongate member being dimensioned to have a length to extend from the pivot to a level above the hood of the vehicle into full view of the driver as the vehicle approaches the back wall, and a stop on the bracket offset from the pivot and extending into the path of the elongate member to position the elongate member in normal position of use to extend upwardly from the pivot at an angle of inclination away from the back wall whereby the driver will be signalled by rocking movement of the elongate member about its pivot in the direction towards the back wall in response to engagement by the forwardmost portion of the vehicle during movement to park the vehicle, with the center of gravity of the rod offset from the pivot in the direction away from the back wall by an amount automatically to return the elongate member in normal position upon disengagement of the vehicle from the elongate member.

2. A parking guide as claimed in claim 1 in which the elongate member extends at an angle of about 10°–30° from the vertical when in normal position of use.

3. A parking guide as claimed in claim 1 in which the stop is rearwardly offset from the pivot when located below the pivot.

4. A parking guide as claimed in claim 1 in which the stop is forwardly offset from the pivot when located above the pivot.

5. A parking guide as claimed in claim 1 which includes a second stop which can be introduced into the path of the elongate member to hold the elongate member in position of non-use.

6. A parking guide as claimed in claim 5 in which the stops comprise openings in the bracket offset rearwardly and forwardly from the pivot, and a pin dimensioned to be received in said opening for positioning the pin one or the other of said openings.

* * * * *